United States Patent [19]

Gamboa et al.

[11] Patent Number: 4,861,241

[45] Date of Patent: Aug. 29, 1989

[54] VALVE GUIDE BRACKET

[75] Inventors: Gerardo Gamboa; Dwayne V. Cochran, both of Midland, Tex.

[73] Assignee: Parker Technology, Inc., Odessa, Tex.

[21] Appl. No.: 153,766

[22] Filed: Feb. 8, 1988

[51] Int. Cl.[4] ..... F04B 29/02

[52] U.S. Cl. ..... 417/454; 417/568; 137/327

[58] Field of Search ..... 417/454, 533, 539, 567, 417/568, 900; 137/327, 454.4

[56] References Cited

U.S. PATENT DOCUMENTS

| | | | |
|---|---|---|---|
| 4,187,059 | 2/1980 | Parker et al. | 417/454 |
| 4,477,236 | 10/1984 | Elliott | 417/454 |
| 4,520,842 | 6/1985 | Elliott | 417/454 X |
| 4,527,961 | 7/1985 | Redwine et al. | 417/454 |
| 4,550,646 | 11/1985 | Miller | 417/568 X |
| 4,573,886 | 3/1986 | Maasberg et al. | 417/454 |
| 4,618,316 | 10/1986 | Elliott | 417/454 |

OTHER PUBLICATIONS

Namekata, Reciprocating Pump, 4/81, WO 81/00889, W1PO, PCT/JP80/00009.

*Primary Examiner*—Carlton R. Croyle
*Assistant Examiner*—Eugene L. Szczecina, Jr.
*Attorney, Agent, or Firm*—Marcus L. Bates

[57] ABSTRACT

Apparatus by which a check valve assembly of a reciprocating pump can be removed. A valve stem of the valve assembly is received within a valve guide which is mounted in a valve guide bracket. The bracket is pivotally attached to a yoke. The yoke is removably fastened to an adaptor. The adaptor is seated in an access port arranged perpendicular respective to the passageway within which the valve seat is mounted. The compressive force of the valve spring maintains the bracket and yoke in assembled configuration respective to the adaptor. The bracket and yoke can be pivoted apart, against the spring force, and removed through the adaptor and then the adaptor can be removed from the access port, theryby gaining access to the remainder of the valve assembly.

20 Claims, 3 Drawing Sheets

VALVE GUIDE BRACKET

BACKGROUND OF THE DISCLOSURE

In U.S. Pat. No. 4,187,059 to Parker, there is disclosed a valve guide construction of an intake valve for use in large multiplex pumps. Reference is made to this previous patent for further background of this invention. As pointed out by Parker, it is desirable that the poppet valve stem in large triplex pumps be axially aligned vertically while lateral support is provided for the poppet valves.

It is necessary that the intake valve in such a multiplex pump have the inner valve stem portion guided within a valve guide located inside the flow area of the pump fluid end. The valve guide must be removable from the fluid end for repairs or replacement of the valve member, and at the same time the valve guide must be easily placed within the fluid end and oriented to provide rigid, dependable valve guiding. Reference is made to U.S. Pat. No. 4,468,174 for further background of a multiplex pump suitable for helicopter transportation.

In a multiplex pump there is limited space for working on the fluid end of the pump. Provision must be made for removing the discharge valve vertically upward, and removing the suction valve rearwardly from the fluid end. The tremendous pressures developed within the fluid end of a multiplex pump requires that there be a minimum of sharp corners and drilled and threaded holes because of stress risers. It would therefore be desirable to have an improved fluid end for a multiplex pump that incorporated a minimum number of stress risers therein so that the fluid end could be built of a minimum size and weight as compared to fluid ends that must necessarily be made massive due to the numerous threaded holes and sharp edges that result in the unwanted stress risers.

Two Roughnecks require several hours of time in order to replace the intake valve assembly of most prior art multiplex pumps. Therefore, it would be desirable to be able to more rapidly service the intake check valve of a triplex mud pump in order to reduce the down time required for field repairs.

The present invention contemplates improvements in the fluid end of a multiplex pump by the provision of a valve guide bracket that enables access to an intake valve assembly in a manner to allow the valve to be removed rearwardly from the fluid end in opposition to the reciprocating piston, and which vertically aligns the valve stem and places the valve assembly within the variable chamber of the fluid end of the pump.

SUMMARY OF THE INVENTION

This invention discloses a valve guide adaptor for a check valve of a reciprocating pump. The improved valve guide adaptor brings about a new method of replacing a check valve in a mud pump. The apparatus of the present invention is for use on a reciprocating pump device having a check valve seated in a passageway formed in the main body of the fluid end of the pump, with there being an access port formed into the main body and arranged perpendicular to the passageway. A valve guide adaptor is seated in the access port and supports a yoke. A bracket having a valve guide thereon is pivotally attached to the yoke and can be pivoted from perpendicular relationship respective to the yoke into a position that forms an obtuse angle therebetween. When the yoke is operatively mounted to the adaptor, the guide is positioned in axial aligned relationship with the check valve seat. Accordingly, the adaptor is mounted in the access port, the valve stem of the valve element is placed within the valve guide of the bracket, the yoke is attached to the adaptor, thereby assembling the apparatus for operation.

In the preferred form of this invention, the adaptor is seated on a shoulder formed in the access port. The yoke is removably attached to the adaptor and relies upon the biasing force of the valve spring to maintain the bracket and yoke properly assembled respective to the valve stem and adaptor.

More specifically, the adaptor has a window formed therethrough, while the yoke and bracket are pinned together with the pin having opposed marginal ends extending past opposed sides of the window. The marginal ends of the pin are received in a pocket formed on opposed sides of the window. The free end of the yoke abuttingly engages an edge of the window. Stop means provided between the yoke and bracket prevent the bracket from being rotated past perpendicular relationship respective to the yoke in one direction, and permits the yoke and bracket to be pivoted apart into an obtuse angle.

This novel construction enables the check valve seat, valve element, and spring to be assembled within the passageway through the access port. Then the yoke and bracket, forcing the bracket against the valve spring, until the free end of the yoke can be positioned under the edge of the window. This arrangement of parts aligns the valve guide with the valve stem, and places the valve guide at a location for capturing the valve element in operative relationship respective to the valve seat. The access port is closed by a blind flange and a nut, which also maintains the adaptor properly seated in the access port.

Accordingly, a primary object of the present invention is the provision of a new combination of a valve guide bracket assembly by which a check valve of a reciprocating pump can be readily serviced in a new and unusual manner.

Another object of this invention is to provide a combination check valve assembly and valve guide assembly for use in conjunction with fluid pumps of the reciprocating type which enables the valve assembly to rapidly be replaced.

A further object of this invention is to provide a guide valve bracket for a reciprocating pump that enables the valve assembly of the pump to be removed and replaced in an efficient manner.

A still further object of this invention is the provision of an improved valve guide bracket for the fluid end of a triplex mud pump which enables the intake valve assembly to be field serviced in a novel manner.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
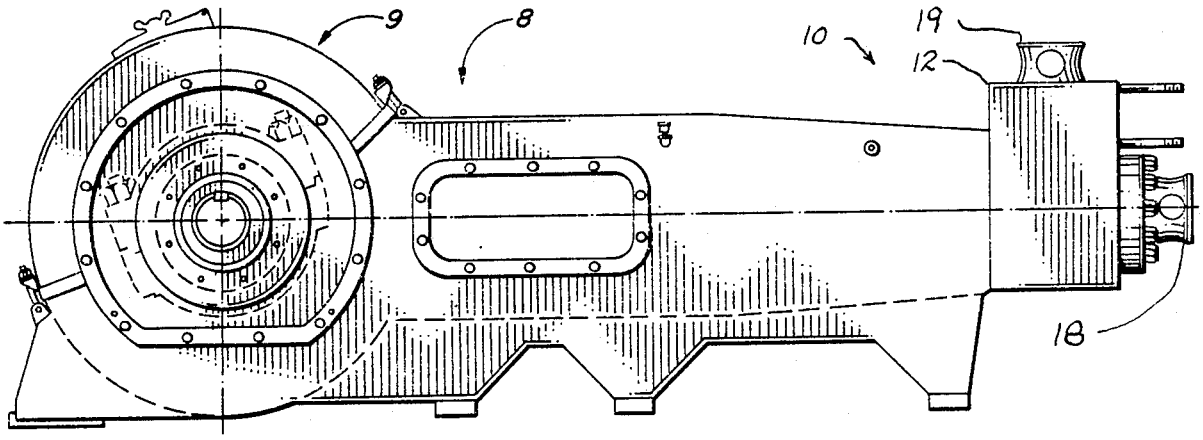
FIG. 1 is a side view of a mud pump that has been made in accordance with the present invention.

In FIG. 1 of the drawings, there is disclosed a reciprocating pump 8, as for example a model H-700-B- Triplex Mud Pump manufactured by OIME, Inc. of Odessa, Texas. The mud pump 8 has a power end 9 and a fluid end assembly 10. Power effected at the power end 9 forces high pressure drilling fluid to flow through the fluid end 10. The fluid end of the mud pump has a main body 12 interconnected to a manifold assembly (not shown) for receiving mud from a mud pit (not shown) and forcing the mud to flow into a drill string (not shown). Triplex mud pumps, mud pits, and drill strings are well known to those skilled in the art and while the present invention is discussed in conjunction with a mud pump, it is contemplated that this invention can also advantageously be used on most any reciprocating pump having some of the problems solved by the present invention.

Figure 2:
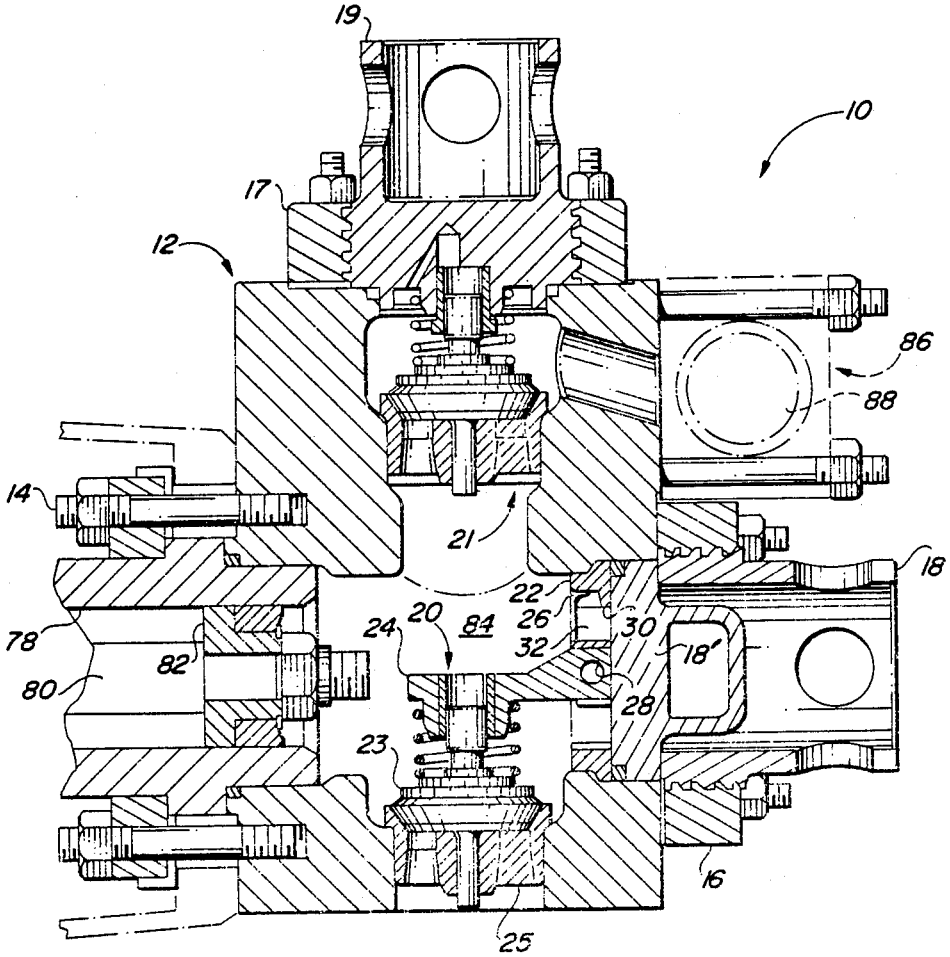
FIG. 2 is an isolated, enlarged, detailed, longitudinal cross-sectional view of part of the apparatus disclosed in FIG. 1.
Figure 4:
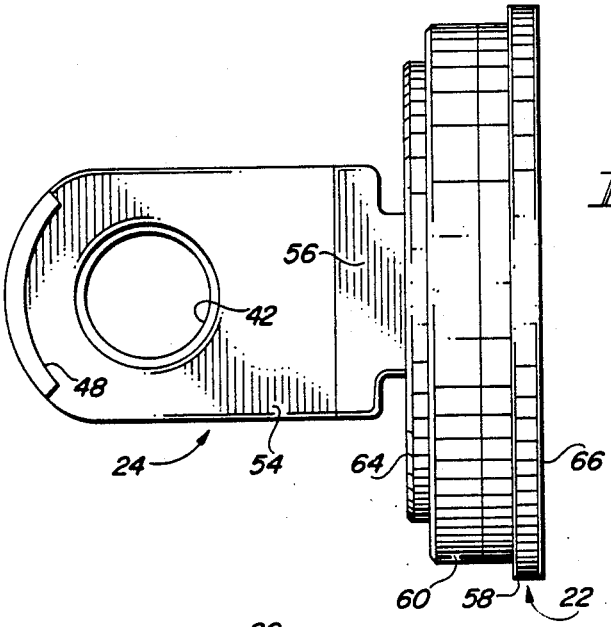
FIG. 4 is a top plan view of part of the apparatus disclosed in FIG. 3.

In FIG. 2, the main body 12 is seen to have a plurality of tension bolts 14 by which the main body 12 is connected to the end of the cylinder of the pump 8. A threaded flange 16 and 17 is bolted onto the main body and provides a threaded surface for accepting nuts 18 and 19. The main body is provided with the illustrated inlet and outlet passageways within which there is appropriately mounted the illustrated intake valve assembly 20 and outlet valve assembly 21.

A lower valve guide adaptor 22, made in accordance with this invention, is seated against a circumferentially extending shoulder formed in the illustrated access passageway. A valve element 23 has the illustrated valve stem thereof reciprocatingly received within a valve guide formed in a valve bracket 24. The valve guide bracket 24 forms part of the present invention. A valve seat 25 is removably seated within the illustrated intake passageway formed in the main body 12.

Figure 3:
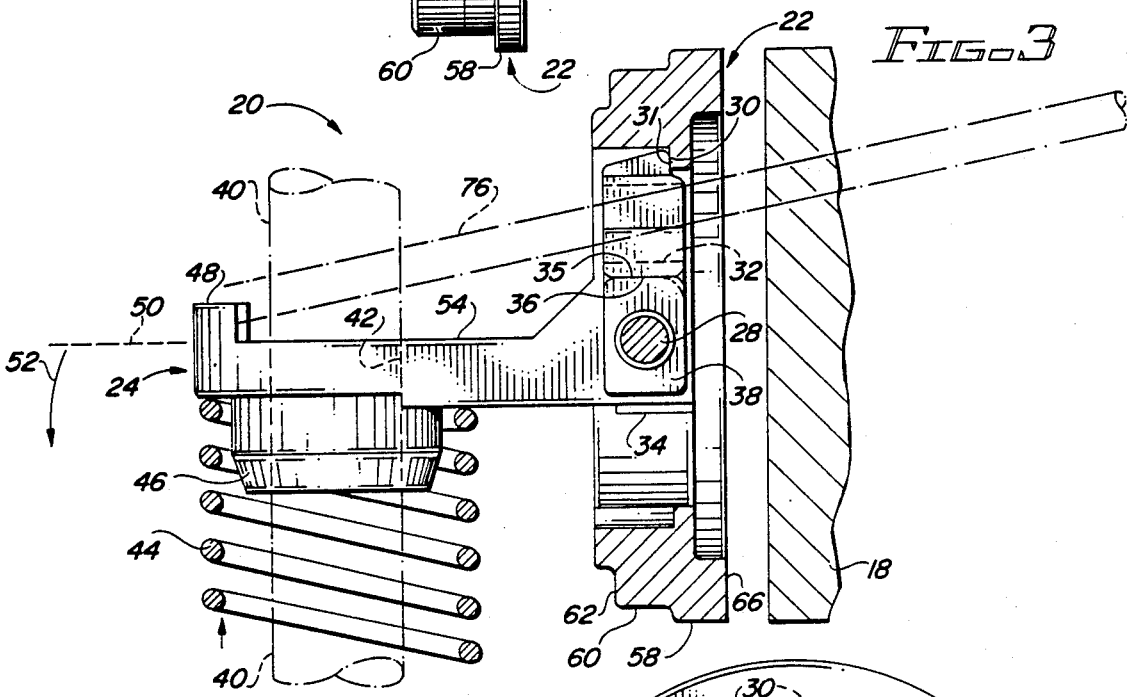
FIG. 3 is a further enlarged, detailed, fragmentary, part cross-sectional view of part of the apparatus disclosed in FIG. 2.
Figure 5:
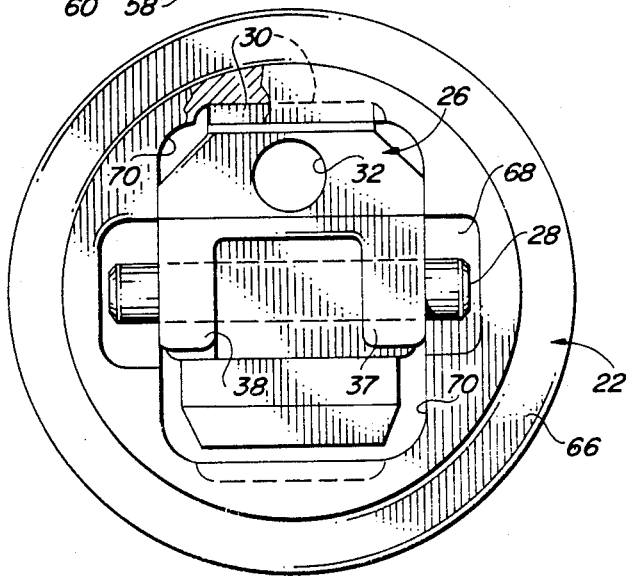
FIG. 5 is an end view of FIG. 4.

The apparatus of the present invention includes a yoke 26 which is pivotally attached to the bracket 24 by means of pin 28. In FIGS. 3–8, the free end of the yoke 26 is seen to have a recess 30 thereon that abuttingly engages a lip 31 formed on the adaptor 22. The recess 30 and lip 31 are positioned respective to one another and to the remaining structure to properly align all of the coacting parts in an optimum manner. The yoke has a hole 32 formed therethrough. As seen in FIGS. 2, 3, and 8, the lower end of the yoke 26 terminates in close proximity to the lower face 34 of the bracket. Coacting stop means 35 and 36, formed on the yoke 26 and bracket 24, abuttingly engage one another and prevent further rotation of the yoke and bracket toward one another in one direction to thereby maintain the illustrated perpendicular relationship as illustrated in FIG. 3. However, as seen in FIG. 8, the yoke and bracket can be pivoted away from one another into an obtuse angle for reasons which will be better appreciated later on as this disclosure is more fully digested. In FIG. 5, it is seen that the yoke has spaced legs 37 and 38 between which there is pivotally received the hinged end of the bracket 24.

As seen in FIG. 3, a valve stem 40 is received within a valve guide 42 formed in the bracket 24. A valve spring 44 is captured about the o.d. 46 of the valve guide.

In FIGS. 3, 4, 6, and 8, it will be noted that the free end of the bracket 24 has a curved barrier 48 formed thereon that facilitates installation and removal of the valve guide bracket assembly. Numeral 50 of FIG. 3 indicates a plane within which the bracket 24 lines. The plane 50 is perpendicular to the axis of the valve seat 25 of FIG. 2. Numeral 52 of FIG. 3 indicates that bracket 24 can be pivoted against valve spring 44 as the bracket and yoke are moved towards the obtuse angle seen illustrated in FIG. 8. The upper surface 54 of the bracket 24 is inclined at 56 (FIG. 8) to join the surfaces 35 and 54 together. Numerals 57 and 58 of FIGS. 3 and 7 indicate different diameters formed on the adaptor which provide a shoulder so that the adaptor can be seated against a co-acting circumferentially extending shoulder formed in the access port so that the adaptor can be seated in the illustrated manner of FIG. 2. In FIG. 3, numerals 60 and 62 indicate other surfaces which form another shoulder on the adaptor. Numerals 64 and 66 of FIG. 4 indicate the inner and outer opposed faces of the adaptor.

Figure 7:
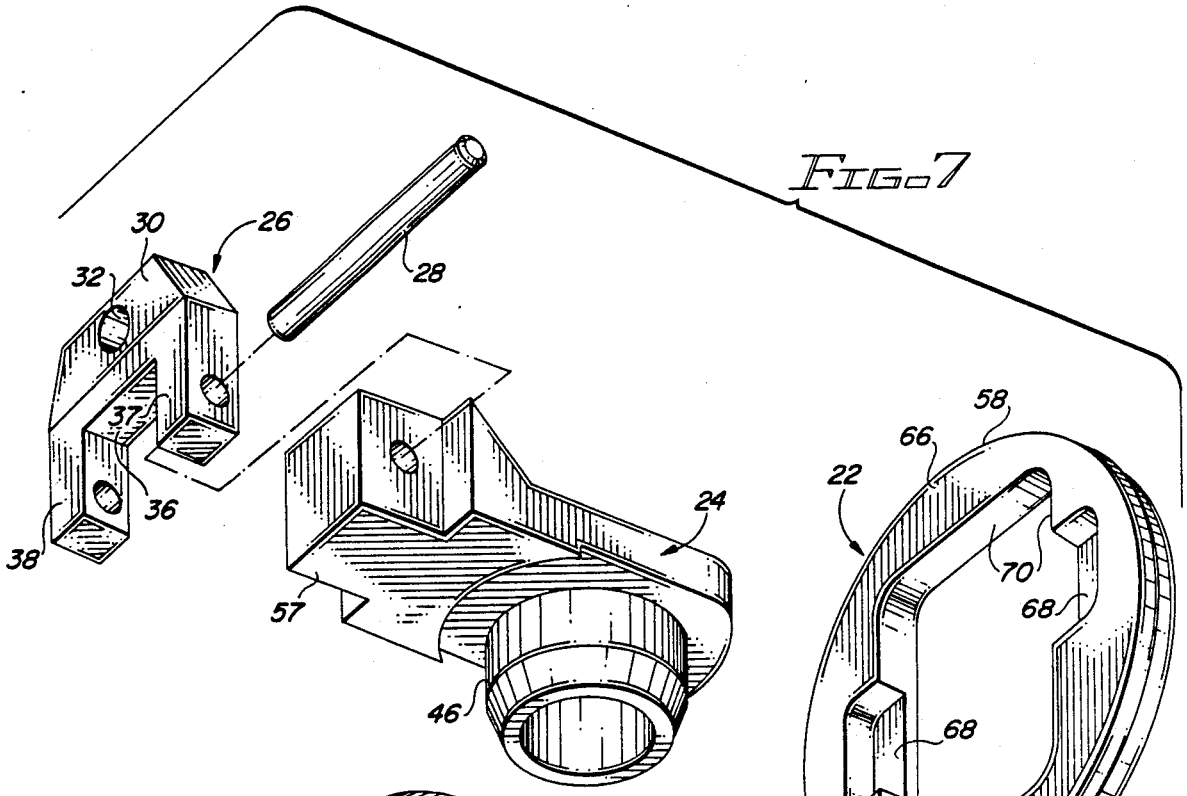
FIG. 7 is a disassembled, perspective view of the apparatus disclosed in FIG. 6; and, FIG. 8 is a part cross-sectional view showing the apparatus of FIG. 3 in an alternate configuration.
Figure 6:
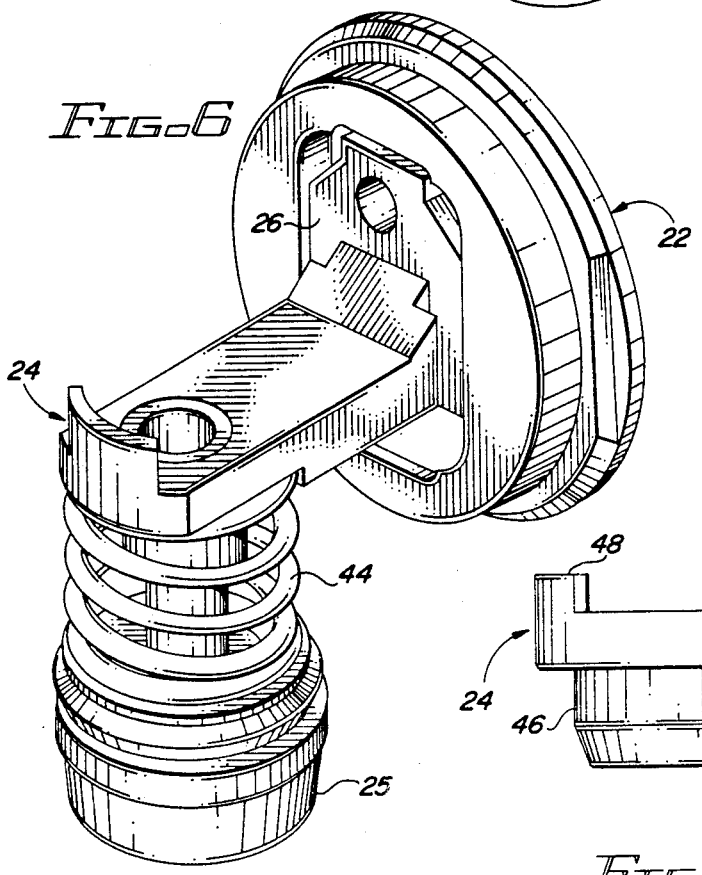
FIG. 6 is a perspective view of the apparatus disclosed in FIG. 5.
Figure 8:
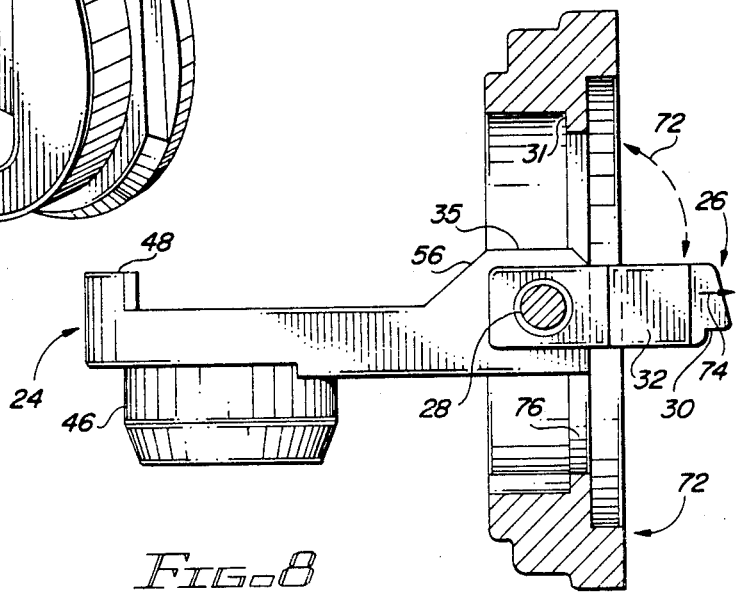

In FIGS. 5 and 7, numeral 68 indicates opposed pockets formed on opposed sides of a window 70 in the adaptor 22 for receiving opposed marginal ends of pin 28 in seated relationship therein. It will be noted that the pockets have a vertical length which permits pin 28 to be forced from a lower to an upper postion therein.

The window 70 is formed between the pockets 68, and is of a size to admit the bracket 25 therethrough. The top of the window is configured into the before mentioned recess 31. Numeral 72 of FIG. 8 indicates the rotation of the yoke from the position of FIG. 8 into the position of FIGS. 2 and 6, for example. Numeral 74 indicates the direction in which the bracket 23, yoke 26, and pin 28 can be moved respective to the adaptor during assembly and disassembly.

In FIG. 3, numeral 76 indicates a bar which extends through the window 70, hole 32, and into engagement with the upturned ledge 48 of the bracket 24.

In FIG. 2, a piston 82 is reciprocatingly received within the variable chamber 84. A mainfold 86 is connected to the main body 12. Outlet 88 is connected to the outlet check valve and conducts flow away from the fluid end and to a drill string. It will be noted that the valve stems of both the intake and outlet check valves are oriented in a vertical direction to thereby minimize wear and increase the efficiency of operation.

In FIG. 3, together with other figures of the drawings, it will be noted that the pin 28 hinges the bracket 24 and yoke 26 together and has opposed marginal ends seated in opposed pockets 68 (FIG. 5) so that the valve spring 44 urges the bracket 24 of FIG. 3 to be pivoted in a clockwise direction about the pin. This action is resisted by the recess 31 and lip 30 formed on the edge of the window 70 and the end of the yoke 26. Accordingly, the stop means 35 and 36 maintain the bracket and yoke perpendicular to one another due to the compressive force of the valve spring, while the moment arm between the pin 28 and the lip 31 prevent the yoke from turning clockwise. The blind flange 18 provides a sealed separator plate which abuttingly engages the face 66 of the valve guide adaptor plate 22. The nut 18 seen in FIG. 2 is threadedly made up within the threaded flange 16 and forces the adaptor plate shoulder against the shoulder of the access port. This maintains the components of the novel valve guide bracket assembly and the components of the valve assembly in assembled relationship during operation of the mud pump. When it comes time to replace any part of the valve assembly, one workman can easily accomplish a field repair as follows:

A tool bar 76 is used to remove nut 18, and thereafter the workman grasps the handle of the blind flange 18' and removes the flange from the access port. Next the tool bar 76 is extended through the window 70, through the port hole 32, and into abutting engagement with the ledge 48. The ledge 48 prevents the tool bar 76 from damaging other components of the pump and gives the workman a definite feel for the free end of the bracket 24. Next the bracket 24 is rotated in the direction of arrow 52 against compression spring 44. This relaxes the force on the pin 28 and lip 31 so that the recess 30 can be slipped downward free of the lip 31 as the pin 28 travels vertically downward within the opposed pockets 68 of the adaptor. Next, the pressure on the bracket is relaxed until the spring 44 is fully extended. The bar 76 is withdrawn, the bracket and yoke rotated into the configuration of FIG. 8, the bracket 24 lifted free of the valve stem, whereupon the bracket, pin, and yoke are removed through the window 70 of the adaptor. Next, the guide adaptor 22 can be removed from the access port, and then the valve spring, valve element, and valve seat can be removed and either serviced or replaced as may be required.

Reassembly of the apparatus is carried out in reverse to the above disassembly procedure.

It is contemplated that the valve guide adaptor 22 can be mounted within the access passageway by any number of different means other than as shown. Further, it will be noted that mating surfaces are formed between the adaptor 22 and the passageway so that the adaptor is always properly oriented or otherwise, the bracket holding the valve guide would be disoriented respective to the valve stem. Further, the end 30 of the yoke and the lip 31 of the adaptor can take on many different forms so long as there is provided co-acting surfaces which abut one another and thereby prevent rotation of the bracket beyond the position that disposes the guide in axially aligned relationship respective to the valve stem.

One skilled in the art, having digested this entire disclosure, will appreciate that assembly of the apparatus is carried out by first placing the valve seat 25 in proper position within the intake passageway in the illustrated manner of FIG. 2. Next, the valve and valve spring are seated within the valve seat. The yoke and bracket along with the pin 28 are assembled and the adaptor is placed in proper seated position within the access passageway. The bracket is extended through the window of the adaptor and the valve guide is next aligned with the valve stem. The yoke is rotated counterclockwise so that a bar 76 can be extended through hole 32 and into engagement with the ledge 48 of the bracket 24. At this time, it is only necessary to pick up on the end of the bar so that the spring 44 is compressed as the lip 30 slides under the recess 31 as the opposed marginal ends of the pin 28 slid vertically upward within the opposed pockets 68. The separator plate 18 is placed against the adaptor and the nut 18 securely made up to the pump is put back into operation.

I claim:

1. A pump device having a main body at a fluid end thereof, a chamber formed within said main body, said chamber is in communication with the variable chamber of the pump, a check valve assembly positioned within said main body for controlling flow through the main body chamber; a flow passageway extending into said main body into communication with the main body chamber for conducting fluid flow therethrough, said check valve assembly includes a valve seat formed in said flow passageway, said valve seat having a longitudinal axis; said check valve assembly includes a valve element, a valve spring, and a valve guide assembly; an access port formed into said main body through which said valve element, spring, and valve guide assembly therefor can be introduced into said main body chamber, said access port has a longitudinal axis arranged perpendicularly respective to said longitudinal axis of said seat; the improvement comprising:

a valve guide adaptor having a window formed therein; means removably mounting said valve guide adaptor in said access port, said valve guide assembly includes a yoke and a bracket; valve stem guide means on said bracket for reciprocatingly receiving and guiding a valve stem of the valve element;

means by which said valve guide bracket is pivotally mounted to said yoke; abutment means on said bracket and said yoke by which the yoke is mounted in a plane perpendicular to the bracket while the yoke is mounted in a plane which is parallel to the axis of the valve stem, and by which the bracket can be pivoted away from the yoke; means formed on said yoke and said adaptor by which the bracket is removably mounted in a plane perpendicular to the axis of the valve stem, and with the valve seat being axially aligned with the valve stem guide means; whereby the yoke can be released from the adaptor, the valve stem removed from the bracket, and the yoke pivoted away from the bracket and then removed through the access port along with the other components of the valve guide assembly.

2. The improvement of claim 1 wherein said means by which said valve guide bracket is pivotally mounted to said yoke is a pin extending through the yoke and bracket and hinges the yoke and bracket together; said yoke has opposed ends with one said end being opposed to the pin and abutingly engaging an edge of the window, the pin has opposed marginal ends that engage the adaptor at a location spaced from the recited edge of the window and provides a means by which the spring acts against the bracket and retains the yoke in mounted relationship respective to the adaptor.

3. The improvement of claim 2 wherein the valve spring urges the bracket to pivot about the pin; the stop abutment means of the bracket and yoke prevent the bracket from rotating best than beyond 90 degrees including angle; the end of the yoke engages the edge of the window and prevents the yoke from rotating beyond vertical about the pin.

4. The improvement of claim 1 wherein said means by which said valve guide bracket is pivotally mounted is a pin; a hole extends through the yoke in alignment with the window through which a bar can be extended into engagement with the free end of the bracket to thereby rotate the bracket against the spring and release the end of the yoke from the adaptor so that the yoke, bracket, and pin can be removed from the main body and thereby gain access to the valve assembly.

5. The improvement of claim 1 wherein said means by which said valve guide bracket is pivotally mounted is a pin; opposed pockets are formed on opposed sides of the window of the adaptor for receiving the marginal ends of the pin therein, thereby holding the pin in abutting relationship against the adaptor.

6. The improvement defined in claim 5 wherein a lip is formed on the edge of the window while a tang is formed on the free end of said yoke for mutually engaging one another and prevent rotation of the yoke about the pin, whereby;

the valve spring urges the bracket to rotate about the pin; the lip prevents the end of the yoke from pivoting about the pin; the coacting stop members on the bracket and the yoke prevent the yoke and bracket from being pivoted towards one another, and the bracket can be forced to pivot against valve spring and away from the yoke whereupon the lip is released from the adaptor, and then the bracket, yoke, and adaptor can all be removed from the port.

7. The improvement of claim 1 wherein said means by which said valve guide bracket is pivotally mounted is a pin which extends through the yoke and bracket and hinges the yoke and bracket together; the pin has opposed marginal ends that engage the adaptor at spaced locations on opposed sides of the window and provides a means by which the bracket and yoke are held in mounted relationship respective to the adaptor; the valve spring urges the bracket to pivot about the pin; the abutment means on the bracket and yoke prevent the bracket from rotating beyond perpendicular relationship; the free end of the yoke engages the edge of the window and prevents the yoke from rotating beyond perpendicular relationship respective to the bracket;

and a hole extends through the adaptor through which a bar can be extended into engagement with the free end of the bracket and thereby rotate the bracket against the spring and thereby release the yoke from the adaptor so that the yoke, bracket, and pin can be removed from the main body and the valve assembly replaced.

8. The improvement of claim 7 wherein opposed pockets are formed on opposed sides of the window of the adaptor for receiving the marginal ends of the pin therein, thereby providing a pivot point for the pin.

9. The improvement of claim 8 wherein a lip is formed on the end of said yoke for engagement with an edge of the window to prevent rotation of the yoke about the pin; whereby the yoke and bracket can be forced apart against the valve spring to urge the bracket to rotate about the pin and thereby release the end of the yoke from the window edge so that the bracket can be forced to pivot against valve spring and away from yoke and the lip then released from the adaptor and then the bracket, yoke, and adaptor are removed from the port after which the valve spring and valve element are removed from the passageway.

10. In a pump having a main body at a fluid end thereof, a chamber formed within said main body which is in comunication with the piston chamber of the pump, a check valve assembly positioned within a passageway formed in said main body for controlling flow through the main body chamber; said check valve assembly includes a valve seat formed in said passageway, said valve seat having a longitudinal axis; said check valve assembly includes a valve element and a valve guide assembly, the method of removing said valve element and valve guide from the main body comprising the steps of:

forming an access port into said main body through which said valve element and valve guide assembly therefor can be introduced into said passageway, arranged said access port to have a longitudinal axis disposed perpendicularly respective to said longitudinal axis of said seat;

forming a circumferrentially extending shoulder in said access port; mounting a valve guide adaptor in seated relationship against said shoulder;

pivotally attaching a yoke to a bracket; placing a valve guide in said bracket for reciprocatingly receiving and guiding a valve stem of said valve element;

forming abutment means on said bracket and said yoke by which the yoke can be pivoted toward the bracket and into perpendicular relationship thereto;

placing the valve stem within the guide of the bracket, moving the bracket, yoke, and valve element into the variable chamber, and mounting the yoke to the valve guide adpator and in a plane parallel to the axis of the valve stem with the valve element being aligned with the valve seat and the bracket being mounted in a plane perpendicular to the axis of the valve stem.

11. The method of claim 10 and further including the step of forming a window through the adaptor; mounting the yoke to the adaptor by hinging the yoke and bracket together with a hinge means that has opposed marginal ends that engage the adaptor at a location on opposed sides of the window and provides a means by which the bracket and yoke are held in mounted relationship respective to the adaptor.

12. The method of claim 11 wherein a marginal edge of the yoke is spaced from the hinge means and is received by an edge portion of the window in a manner such that the valve spring urges the bracket to pivot about the hinge means while the abutment means of the bracket and yoke prevent the bracket from rotating beyond perpendicular relationship and the marginal edge of the yoke, the edge portion of the window, and the hinge means prevent the yoke from rotating beyond parallel relationship respective to the axis of the valve stem.

13. The method of claim 12 and further including the steps of forming a hole that extends through the yoke and extending a bar through the hole and into engagement with a free end of the bracket and thereby rotate the bracket against the spring to release the yoke from the adaptor so that the yoke, bracket, and hinge means can be removed from the main body and the valve assembly replaced.

14. The method of claim 13 wherein opposed pockets are formed on opposed sides of the window of the adaptor for receiving the marginal ends of the hinge means therein, thereby providing a means by which the yoke can be properly positioned respective to the adaptor.

15. The method of claim 10 and further including the steps of forming a lip on said adaptor and engaging the end of the yoke with the lip to prevent rotation of the yoke about the hinge means; forming an opening through the adaptor through which the bracket can be received;

using the valve spring to urge the bracket to rotate about the hinge means; using the lip to prevent the end of the yoke from pivoting about the hinge means; forming coacting stop members on the bracket and the yoke to prevent the yoke and bracket from being pivoted towards one another in one direction;

forcing the bracket to pivot against the valve spring and away from yoke and thereby release the lip from the adaptor; whereupon the bracket, yoke, and adaptor are removed from the access port and then the valve spring and valve element are removed from the passageway.

16. The method of claim 10 wherein there is further included the steps of using a pin to extend through the yoke and bracket and hinge the two together; seating the opposed marginal ends of the pin within a pocket formed in the adaptor and engaging the adaptor with the free end of the yoke at a location spaced from the pin;

and providing a means by which the bracket and yoke are held in mounted relationship respective to the adaptor by using the valve spring to urge the bracket to pivot about the pin;

using the abutment means of the bracket and yoke to prevent the bracket from rotating toward the yoke beyond a location that aligns the valve guide with the valve stem;

and forming a hole which extends through the adaptor through which a bar can be extended into engagement with the free end of the bracket and thereby rotate the bracket against the spring and release the yoke from the adaptor so that the yoke, bracket, and pin can be removed from the main body and the valve assembly replaced.

17. The method of claim 11 wherein a pin hinges the yoke and bracket together; opposed pockets are formed on opposed sides of the window of the adaptor for receiving the marginal ends of the pin therein, thereby providing a mount for the marginal ends of said pin and a means of moving the mounted yoke vertically to engage and to disengage the yoke from the adaptor.

18. In a pump apparatus of the type having a variable chamber formed therein, said pump having a fluid end opposed to a power end, a main body forms the fluid end, a passageway in said main body in communication with the variable chamber through which fluid is forced to flow, a check valve assembly in said passageway; an access port in said main body arranged perpendicular to the passageway and in communication with the variable chamber; the method of removing a valve element and valve guide from the fluid end of a pump comprising the steps of:

mounting a valve guide adaptor in said access port; pivotally attaching a yoke to a bracket in a manner to enable the yoke to be pivoted toward the bracket and into perpendicular relationship thereto and away from the bracket into an obtuse angle respective thereto;

placing a valve guide means in said bracket for reciprocatingly receiving and guiding a valve stem of said valve element;

moving the bracket and yoke into the variable chamber, placing the valve stem in the valve guide and mounting the yoke to the adaptor in a plane parallel to the axis of the valve stem with the valve element being aligned with the valve seat and the bracket being mounted in a plane perpendicular to the axis of the valve stem.

19. The method of claim 18 and further including the step of mounting the yoke to the adaptor by hinging the yoke and bracket together with a hinge means that has opposed marginal ends that engage the adaptor at one location that is spaced from another location where the yoke engages the adaptor and provides a means by which the bracket and yoke are held in mounted relationship respective to the adaptor.

20. In a pump apparatus of the type having a variable chamber formed therein, with there being a fluid end opposed to a power end, a main body forms the fluid end, a passageway in said main body in communication with the variable chamber through which fluid is forced to flow; a check valve assembly in said passageway; an access port in said main body arranged perpendicular to the passageway and in communication with the variable chamber;

the combination with said main body and check valve assembly of a valve guide assembly;

said check valve assembly includes a valve seat formed in said flow passageway, a valve element, and a valve spring, said valve seat having a longitudinal axis, said access port has a longitudinal axis arranged perpendicularly respective to said longitudinal axis of said seat; means in said access port for mounting said valve guide assembly therein; said valve guide assembly includes a yoke, a bracket, and an adaptor; valve guide means on said bracket for reciprocatingly receiving and guiding a valve stem of the valve element; means by which said valve guide bracket is pivotally mounted to said yoke to enable said bracket and said yoke to be pivoted into perpendicular relationship to one another while the yoke is mounted to the adaptor and in a plane which is parallel to the axis of the valve stem, and by which the bracket can be pivoted away from the yoke;

said yoke is removably mounted in a plane parallel to the axis of the valve stem, and with the valve seat being axially aligned with the valve stem guide; whereby the yoke can be released from the adaptor, the valve stem removed from the bracket, and the yoke and bracket pivoted away from one another and removed through the access port.

* * * * *

UNITED STATES PATENT AND TRADEMARK OFFICE

CERTIFICATE OF CORRECTION

PATENT NO. : 4,861,241

DATED : August 29, 1989

INVENTOR(S) : GERARDO GAMBOA ET AL

It is certified that error appears in the above-identified patent and that said Letters Patent is hereby corrected as shown below:

Abstract, line 14, "theryby" should be --thereby--.

Column 2, line 31, delete the comma after "bracket" and insert --are pivoted apart into an obtuse angle and moved into the access port with the bracket extending through the window until the guide is aligned with the valve stem and the pin ends abut the pockets. Next, the yoke is forced to pivot toward the bracket, -- before "forcing".

Column 5, line 8, substitute --18'-- for "18".

Column 6, line 66, delete "stop";

Line 68, substitute --less than 90 degrees-- for "best than beyond 90 degrees".

Signed and Sealed this

Twenty-eighth Day of August, 1990

*Attest:*

HARRY F. MANBECK, JR.

*Attesting Officer*

*Commissioner of Patents and Trademarks*